US010213836B2

(12) United States Patent
Vernieres et al.

(10) Patent No.: US 10,213,836 B2
(45) Date of Patent: Feb. 26, 2019

(54) GAS PHASE SYNTHESIS OF STABLE SOFT MAGNETIC ALLOY NANOPARTICLES

(71) Applicant: Okinawa Institute of Science and Technology School Corporation, Okinawa (JP)

(72) Inventors: Jerome Vernieres, Okinawa (JP); Maria Benelmekki Erretby, Okinawa (JP); Jeong-Hwan Kim, Okinawa (JP); Rosa Estela Diaz Rivas, Okinawa (JP); Mukhles Ibrahim Sowwan, Okinawa (JP)

(73) Assignee: OKINAWA INSTITUTE OF SCIENCE AND TECHNOLOGY SCHOOL CORPORATION, Okinawa (JP)

( * ) Notice: Subject to any disclaimer, the term of this patent is extended or adjusted under 35 U.S.C. 154(b) by 0 days.

(21) Appl. No.: 15/501,309

(22) PCT Filed: Aug. 6, 2015

(86) PCT No.: PCT/JP2015/003973
§ 371 (c)(1),
(2) Date: Feb. 2, 2017

(87) PCT Pub. No.: WO2016/021205
PCT Pub. Date: Feb. 11, 2016

(65) Prior Publication Data

US 2017/0216924 A1 Aug. 3, 2017

Related U.S. Application Data

(60) Provisional application No. 62/034,498, filed on Aug. 7, 2014.

(51) Int. Cl.
*B22F 9/12* (2006.01)
*B22F 1/02* (2006.01)
(Continued)

(52) U.S. Cl.
CPC ..... *B22F 9/12* (2013.01); *B22F 1/0018* (2013.01); *B22F 1/0044* (2013.01);
(Continued)

(58) Field of Classification Search
CPC .... B22F 1/0018; B22F 1/0044; B22F 1/0062; B22F 1/02; B22F 9/12; B22F 2201/11;
(Continued)

(56) References Cited

U.S. PATENT DOCUMENTS 5,589,234 A 12/1996 Mori et al.
5,788,738 A 8/1998 Pirzada et al.
(Continued)

FOREIGN PATENT DOCUMENTS

CA 2 426 665 C 8/2008
CN 1786686 A 6/2006
(Continued)

OTHER PUBLICATIONS

A. Makino, T. Hatanai, Y. Naitoh, T. Bitoh, A. Inoue and T. Masumoto, Applications of Nanocrystalline Soft Magnetic Fe—M—B (M=Zr, Nb) Alloys "Nanoperm", IEEE, T. Mag., Sep. 5, 1997, 33, 3793-3798. (Mentioned in paragraph Nos. 2-3 of the as-filed specification.).
(Continued)

*Primary Examiner* — Rodney G McDonald
(74) *Attorney, Agent, or Firm* — Chen Yoshimura LLP

(57) ABSTRACT

A soft magnetic nanoparticle comprising an iron aluminide nanoalloy of the $DO_3$ phase as a core encapsulated in an inert shell made of alumina.

3 Claims, 9 Drawing Sheets

(51) Int. Cl.

| | |
|---|---|
| ***H01F 1/00*** | (2006.01) |
| ***B22F 1/00*** | (2006.01) |
| ***C22C 38/06*** | (2006.01) |
| ***H01F 1/153*** | (2006.01) |

(52) U.S. Cl.
CPC ..... *B22F 1/0062* (2013.01); *B22F 1/02* (2013.01); *C22C 38/06* (2013.01); *H01F 1/0054* (2013.01); *H01F 1/153* (2013.01); *H01F 1/15341* (2013.01); *B22F 2201/11* (2013.01); *B22F 2202/05* (2013.01); *B22F 2301/35* (2013.01); *B22F 2302/253* (2013.01); *B22F 2302/45* (2013.01); *B22F 2998/10* (2013.01); *B22F 2999/00* (2013.01)

(58) Field of Classification Search
CPC ..... B22F 2202/05; B22F 2301/35; B22F 2302/253; B22F 2302/45; B22F 2498/10; B22F 2999/00; B22F 2998/10; C22C 38/06; H01F 1/0054; H01F 1/153; H01F 1/15341; C23C 14/14; C23C 14/165; C23C 14/228; C23C 14/5853
USPC ..... 204/192.2
See application file for complete search history.

(56) References Cited

U.S. PATENT DOCUMENTS

| | | | |
|---|---|---|---|
| 6,368,406 | B1 | 4/2002 | Deevi et al. |
| 6,688,494 | B2 | 2/2004 | Pozarnsky et al. |
| 6,720,074 | B2 | 4/2004 | Zhang et al. |
| 6,746,508 | B1 | 6/2004 | Deevi et al. |
| 7,547,344 | B2 | 6/2009 | Deevi et al. |
| 8,016,944 | B2 | 9/2011 | Kortshagen et al. |
| 8,137,459 | B2 | 3/2012 | Paton et al. |
| 2008/0311031 | A1 | 12/2008 | Vitner et al. |
| 2012/0208026 | A1 | 8/2012 | Zhou et al. |

FOREIGN PATENT DOCUMENTS

| | | | |
|---|---|---|---|
| CN | 101346304 | A | 1/2009 |
| CN | 103824673 | A | 5/2014 |
| JP | 9-12948 | A | 1/1997 |
| JP | 2000-87233 | A | 3/2000 |
| JP | 2000-178613 | A | 6/2000 |
| JP | 2008-88453 | A | 4/2008 |
| JP | 2010-207322 | A | 9/2010 |
| JP | 2014-12794 | A | 1/2014 |
| WO | 1999/024173 | A1 | 5/1999 |
| WO | 02/22918 | A1 | 3/2002 |

OTHER PUBLICATIONS

T. Osaka, M. Takai, K. Hayashi, K. Ohashi, M. Saito and K. Yamada, "A soft magnetic CoNiFe film with high saturation magnetic flux density and low coercivity", Nature, Apr. 12, 1998, 392, 796-798. (Mentioned in paragraph Nos. 2-3 of the as-filed specification.).

O. Margeat, D. Ciuculescu, P. Lecante, M. Respaud, C. Amiens and B., Chaudret, "NiFe Nanoparticles: A Soft Magnetic Material?" small, 2007, 3, 451-458. (Mentioned in paragraph Nos. 3-4 of the as-filed specification.).

M. Benelmekki, M. Bohra, J.-H. Kim, R. E. Diaz, J. Vemieres, P. Grammatikopoulos and M. Sowwan, "A facile single-step synthesis of ternary multicore magneto-plasmonic nanoparticles", Nanoscale, Jan. 29, 2014, 6, 3532-3535. (Mentioned in paragraph Nos. 3 and 16 of the as-filed specification.).

V. Singh, C. Cassidy, P. Grammatikopoulos, F. Djurabekova, K. Nordlund and M. Sowwan, "Heterogeneous Gas-Phase Synthesis and Molecular Dynamics Modeling of Janus and Core-Satellite Si—Ag Nanoparticles", J. Phys. Chem. C., 2014, ASAP. (Mentioned in paragraph Nos. 3 and 16 of the as-filed specification.).

H. Graupner, L. Hammer, K. Heinz and D. M. Zehner, "Oxidation of low-index FeA1 surfaces", Surf. Sci., 1997, 380, 335-351. (Mentioned in paragraph Nos. 3, 16, and 20 of the as-filed specification.).

E. Quesnel, E. Pauliac-Vaujour and V. Muffato, "Modeling metallic nanoparticle synthesis in a magnetron-based nanocluster source by gas condensation of a sputtered vapor", J. Appl. Phys., 2010, 107, 054309. (Mentioned in paragraph Nos. 3 and 18 of the as-filed specification.).

J. F. Moulder, W. F. Stickle, P. E. Sobol, K. D. Bomben, "Handbook of X-ray photoelectron spectroscopy", ISBN 0-9627026-2-5 ED Jill Chastain. Pub. Perkin Elmer Corporation, 1992. (Mentioned in paragraph Nos. 3 and 20 of the as-filed specification.).

T. Yamashita and P. Hayes, "Analysis of XPS spectra of Fe2+ and Fe3+ ions in oxide materials", Appl. Surf. Sci., 2008, 254, 2441-2449. (Mentioned in paragraph Nos. 3 and 20 of the as-filed specification.).

G. A. Castillo Rodriguez, G. G. Guillen, M. I. Mendivil Palma, T. K Das Roy, A. M. Guzman Hernandez, B. Krishnan and S. Shaji, "Synthesis and Characterization of Hercynite Nanoparticles by Pulsed Laser Ablation in Liquid Technique", Int. J. Appl. Ceram. Technol., 2014, 11, 1-10. (Mentioned in paragraph No. 3 of the as-filed specification).

Y. B. Pithwalla, M. S. El-Shall, S. C. Deevi, V. Strom and K. V. Rao, "Synthesis of Magnetic Intermetallic FeAl Nanoparticles from a Non-Magnetic Bulk Alloy", J. Phys. Chem. B, Mar. 22, 2001, 105, 2085-2090. (Mentioned in paragraph Nos. 3 and 21 of the as-filed specification.).

K. Suresh, V. Selvarajan and I. Mohai, "Synthesis and characterization of iron aluminide nanoparticles by DC thermal plasma jet", Vaccum, 2008, 82, 482-490. (Mentioned in paragraph Nos. 3 and 21 of the as-filed specification.).

S. Chen, Y. Chen, Y. Tang, B. Luo, Z. Yi, J. Wei and W. Sun, "Synthesis and characterization of FeAl nanoparticles by low-levitation method", J. Cent. South Univ., 2013, 20, 845-850. (Mentioned in paragraph Nos. 3 and 21 of the as-filed specification.).

M. Kaur, J. S. McCloy, W. Jiang, Q. Yao and Y. Qiang, "Size Dependence of Inter- and Intracluster Interactions in Core-Shell Iron—Iron Oxide Nanoclusters", J. Phys. Chem. C, 2012, 116, 12875-12885 (Mentioned in paragraph Nos. 3 and 21 of the as-filed specification.).

N. A. Frey, S. Peng, K. Cheng and S. Sun, "Magnetic nanoparticles: synthesis, functionalization, and applications in bioimaging and magnetic energy storage", Chem. Soc. Rev., 2009, 38, 2535-2542. (Mentioned in paragraph Nos. 3 and 21 of the as-filed specification.).

A. Meffre, B. Mehdaoui, V. Kelsen, P. F. Fazzini, J. Carrey, S. Lachaize, M. Respaud and B. Chaudret, "A Simple Chemical Route toward Monodisperse Iron Carbide Nanoparticles Displaying Tunable Magnetic and Unprecedented Hyperthermia Properties", Nano Lett., 2012, 12, 4722-4728. (Mentioned in paragraph Nos. 3 and 21 of the as-filed specification.).

G. Huang, J. Hu, H. Zhang, Z. Zhou, X. Chi and J. Gao, "Highly magnetic iron carbide nanoparticles as effective T2 contrast agents", Nanoscale, 2014, 6, 726-730. (Mentioned in paragraph Nos. 3 and 21 of the as-filed specification.).

P. Tartaj, M. del Puerto Morales, S. Veintemillas-Verdaguer, T. Gonzalez-Carreno and C. J Serna, "The preparation of magnetic nanoparticles for applications in biomedicine", J. Phys. D: Appl. Phys., 2003, 36, R182-R197. (Mentioned in paragraph Nos. 3 and 21 of the as-filed specification.).

L. Zhang, F. Yu, A. J. Cole, B. Chertok, A. E. David, J. Wang and V. C. Yang, "Gum Arabic-Coated Magnetic Nanoparticles for Potential Application in Simultaneous Magnetic Targeting and Tumor Imaging", The APPS Journal, 2009, 11, 693-699. (Mentioned in paragraph Nos. 3 and 24 of the as-filed specification.).

H. Zhang, G. Shan, H. Liu and J. Xing, "Surface modification of γ-Al2O3 nano-particles with gum arabic and its applications in adsorption and biodesulfurization", Surf. Coat. Tech., 2007, 201, 6917-6921 (Mentioned in paragraph Nos. 3 and 25 of the as-filed specification.).

(56) References Cited

OTHER PUBLICATIONS

J. Yang, W. Hu, J. Tang and X. Dai, "The formation of FecoreAlshell and FeshellAlcore nanoparticles, a molecular dynamics simulation", Comp. Mater. Sci., 2013, 74, 160-164. (Mentioned in paragraph Nos. 3 and 27 of the as-filed specification.).
X. Shu, W. Hu, H. Xiao, H. Deng and B. Zhang, "Vacancies and Antisites in B2 FeAl and DO3 Fe3Al with Modified Analytic EAM Model", J. Mater. Sci. Technol., 2001, 17, 601-604. (Mentioned in paragraph Nos. 3 and 29 of the as-filed specification.).
International Search Report (ISR) issued in PCT/JP2015/003973 dated Oct. 2015.
Written Opinion (PCT/ISA/237) issued in PCT/JP2015/003973 dated Oct. 2015.
Liu et al., "Preparation and characteristics of Fe3Al nanoparticles by hydrogen plasma-metal reaction", Solid State Communications, Feb. 2003, vol. 125, No. 7, pp. 391-394 (Cited in the ISR above.).
Gonzalez et al., "Synthesis and Characterization of Nanophase Particles Obtained by D.C. Sputtering", Scripta Materialia, May 18, 2001, vol. 44, Nos. 8/9, pp. 1883-1887 (Cited in the ISR above.).
Hahn et al., "The production of nanocrystalline powders by magnetron sputtering", Journal of Applied Physics, Jan. 15, 1990, vol. 67, No. 2, pp. 1113-1115 (Cited in the ISR above.).
Maicu et al., "Synthesis and deposition of metal nanoparticles by gas condensation process", Journal of Vaccum Science & Technology A, Mar./Apr. 2014, vol. 32, No. 2, pp. 02B113-1-02B113-9 (Cited in the ISR above.).
Chen et al., "Bulk Synthesis of Fe3Al Intermetallic Compound Nanoparticles by Flow-Levitation Method", NANO Brief Reports and Reviews, Jan. 2015, vol. 10, No. 1, pp. 1550002-1-1550002-5 (Cited in the ISR above.).
A. Fernandez et al., "Application of the gas phase condensation to the preparation of nanoparticles", Vacuum, 1999, vol. 52, pp. 83-88.
Y. B. Pithawalla et al., "Preparation of ultrafine and nanocrystalline FeAl powders", Materials Science and Engineering, A329-331, 2002, pp. 92-98.
V. Abdelsayed et al., "Differential mobility analysis of nanoparticles generated by laser vaporization and controlled condensation (LVCC)", Journal of Nanoparticle Research, 2006, 8, pp. 361-369.
A. Tavakoli et al., "A Review of Methods for Synthesis of Nanostructured Metals with Emphasis on Iron Compounds", Institute of Chemistry, Slovak Academy of Sciences, Chemical Papers, 2007, 61(3), pp. 151-170.
F. E. Kruis et al., "Synthesis of Nanoparticles in the Gas Phase for Electronic, Optical and Magnetic Applications—A Review", Journal of Aerosol Science, 1998, vol. 29, No. 5/6, pp. 511-535.
Z.H. Wang et al., "Characterization of Fe—Co alloyed nanoparticles synthesized by chemical vapor condensation", Materials Letters, 2003, 57, pp. 3560-3564.
D. L. Peng et al., "Formation and magnetic properties of Fe—Pt alloy clusters by plasma-gas condensation", Applied Physics Letters, Jul. 14, 2003, vol. 83, No. 2, pp. 350-352.
N. H. Hai et al., "Iron and Cobalt-based magnetic fluids produced by inert gas condensation", Journal of Magnetism and Magnetic Materials, 2005, 293, pp. 75-79.
European Search Report dated Feb. 23, 2018, in a counterpart European patent application No. 15830316.4.
Liu et al., "Oxidation behaviour of Fe3A1 nanoparticles prepared by hydrogen plasma-metal reaction", Nanotechnology, Institute of Physics Publishing, May 1, 2003 (May 1, 2003), vol. 14, No. 5, pp. 542-545.
Vernieres et al., "Single-step gas phase synthesis of stable iron aluminide nanoparticles with soft magnetic properties", APL Materials, American Institutee of Physics, Nov. 1, 2014 (Nov. 1, 2014), vol. 2, No. 11, 116105.
Chinese Office Action dated Feb. 5, 2018, in a counterpart Chinese patent application No. 201580042679.3.
Yamin Li et al., "High Temperature Oxidation of Fe3Al Alloy Solidified in Permanent Mould", Material & Heat Treatment, Jul. 2012, vol. 41, No. 14, pp. 67-71 (Cited in the Chinese Office Action below and English abstract included as a concise explanation of relevance.).
Chinese Office Action dated Aug. 23, 2018, in a counterpart Chinese patent application No. 201580042679.3.
Japanese Office Action dated Jun. 12, 2018, in a counterpart Japanese patent application No. 2017-504117. (A machine translation (not reviewed for accuracy) attached.).

GAS PHASE SYNTHESIS OF STABLE SOFT MAGNETIC ALLOY NANOPARTICLES

TECHNICAL FIELD

The present invention relates to gas phase synthesis of stable soft magnetic alloy nanoparticles. This application hereby incorporates by reference U.S. Provisional Application No. 62/034,498, filed Aug. 7, 2014, in its entirety.

BACKGROUND

In the past century, soft magnetic alloys have been intensively investigated for a wide range of applications such as power transformers, inductive devices, magnetic sensors, etc., (see Non-patent literatures NPLs 1 and 2). In the era of nanotechnology, soft magnetic materials with nanoscale dimensions are highly desirable. It would require uniform bimetallic nanoalloys with soft magnetic behavior to answer this technological demand.

CITATION LIST

Non Patent Literature

NPL 1: A. Makino, T. Hatanai, Y. Naitoh, T. Bitoh, A. Inoue and T. Masumoto, IEEE T. Mag., 1997, 33, 3793-3798.

NPL 2: T. Osaka, M. Takai, K. Hayashi, K. Ohashi, M. Saito and K. Yamada, Nature, 1998, 392, 796-798.

NPL 3: O. Margeat, D. Ciuculescu, P. Lecante, M. Respaud, C. Amiens and B. Chaudret, small, 2007, 3, 451-458.

NPL 4: M. Benelmekki, M. Bohra, J.-H. Kim, R. E. Diaz, J. Vernieres, P. Grammatikopoulos and M. Sowwan, Nanoscale, 2014, 6, 3532-3535.

NPL 5: V. Singh, C. Cassidy, P. Grammatikopoulos, F. Djurabekova, K. Nordlund and M. Sowwan, J. Phys. Chem. C., 2014, ASAP.

NPL 6: H. Graupner, L. Hammer, K. Heinz and D. M. Zehner, Surf. Sci., 1997, 380, 335-351.

NPL 7: E. Quesnel, E. Pauliac-Vaujour and V. Muffato, J. Appl. Phys., 2010, 107, 054309.

NPL 8: J. F. Moulder, W. F. Stickle, P. E. Sobol, K. D. Bomben, Handbook of X-ray photoelectron spectroscopy, ISBN 0-9627026-2-5 ED Jill Chastain. Pub. Perkin Elmer Corporation, 1992.

NPL 9: T. Yamashita and P. Hayes, Appl. Surf. Sci., 2008, 254, 2441-2449.

NPL 10: G. A. Castillo Rodriguez, G. G. Guillen, M. I. Mendivil Palma, T. K. Das Roy, A. M. Guzman Hernandez, B. Krishnan and S. Shaji, Int. J. Appl. Ceram. Technol., 2014, 11, 1-10.

NPL 11: Y. B. Pithwalla, M. S. El-Shall, S. C. Deevi, V. Strom and K. V. Rao, J. Phys. Chem. B, 2001, 105, 2085-2090.

NPL 12: K. Suresh, V. Selvarajan and I. Mohai, Vaccum, 2008, 82, 482-490.

NPL 13: S. Chen, Y. Chen, Y. Tang, B. Luo, Z. Yi, J. Wei and W. Sun, J. Cent. South Univ., 2013, 20, 845-850.

NPL 14: M. Kaur, J. S. McCloy, W. Jiang, Q. Yao and Y. Qiang, J. Phys. Chem. C, 2012, 116, 12875-12885.

NPL 15: N. A. Frey, S. Peng, K. Cheng and S. Sun, Chem. Soc. Rev., 2009, 38, 2535-2542.

NPL 16: A. Meffre, B. Mehdaoui, V. Kelsen, P. F. Fazzini, J. Caney, S. Lachaize, M. Respaud and B. Chaudret, Nano Lett., 2012, 12, 4722-4728.

NPL 17: G. Huang, J. Hu, H. Zhang, Z. Zhou, X. Chi and J. Gao, Nanoscale, 2014, 6, 726-730.

NPL 18: P. Tartaj, M. del Puerto Morales, S. Veintemillas-Verdaguer, T. Gonzalez-Carreno and C. J Serna, J. Phys. D: Appl. Phys., 2003, 36, R182-R197.

NPL 19: L. Zhang, F. Yu, A. J. Cole, B. Chertok, A. E. David, J. Wang and V. C. Yang, The APPS Journal, 2009, 11, 693-699.

NPL 20: H. Zhang, G. Shan, H. Liu and J. Xing, Surf. Coat. Tech., 2007, 201, 6917-6921.

NPL 21: J. Yang, W. Hu, J. Tang and X. Dai, Comp. Mater. Sci., 2013, 74, 160-164.

NPL 22: X. Shu, W. Hu, H. Xiao, H. Deng and B. Zhang, J. Mater. Sci. Technol., 2001, 17, 601-604.

SUMMARY OF INVENTION

Technical Problem

However, when bimetallic systems are considered at the nanoscale, oxidation, phase segregation, and agglomeration due to inter-particle magnetic interactions are expected, resulting in the alteration of magnetic properties and raising the question of the feasibility of soft magnetic nanoalloys (NPL 3)

Accordingly, the present invention is directed to gas phase synthesis of stable soft magnetic alloy nanoparticles. In particular, in one aspect, the present disclosure provides a novel approach to overcome the limitations of the exiting art.

An object of the present invention is to perform gas phase synthesis of stable soft magnetic alloy nanoparticles in a reasonably inexpensive, well-controlled manner.

Another object of the present invention is to provide stable soft magnetic alloy nanoparticles that obviate one or more of the problems of the prior art.

Solution to Problem

To achieve these and other advantages and in accordance with the purpose of the present invention, as embodied and broadly described, in one aspect, the present invention provides a soft magnetic nanoparticle comprising an iron aluminide nanoalloy of the $DO_3$ phase as a core encapsulated in an inert shell made of alumina.

In another aspect, the present invention provides a method for forming soft magnetic nanoparticles each comprising an iron aluminide nanoalloy of the $DO_3$ phase as a core encapsulated in an inert shell made of alumina, the method comprising: producing a supersaturated vapor of metal atoms of Al and Fe in an aggregate zone by co-sputtering Fe atoms and Al atoms in an Ar atmosphere; producing larger nanoparticles from the supersaturated vapor; causing the larger nanoparticles to pass through an aperture with a pressure differential before and after the aperture so as to create a nanocluster beam of the nanoparticles emerging from the aperture; and directing the nanocluster beam to a substrate to deposit the nanoparticles onto the substrate.

Advantageous Effects of Invention

According to the present invention, it becomes possible to provide stable soft magnetic alloy nanoparticles that have a wide range of industrial applicability.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

It is to be understood that both the foregoing general description and the following detailed description are exemplary and explanatory, and are intended to provide further explanation of the invention as claimed.

BRIEF DESCRIPTION OF DRAWINGS

FIG. 1, (a) is a SEM image of the as-deposited nanoparticles. FIG. 1, (b) shows a size distribution of the nanoparticles showing an average diameter of 10.8 nm+−2.5 nm. FIG. 1, (c) is a TEM micrograph revealing a distinctive core-shell structure. FIG. 1, (d) is an ADF-STEM image of a representative nanoparticle. FIG. 1, (e) is EELS line profiles along the nanoparticle for $FeL_{2,3}$ (707 eV), Al $L_{2,3}$ (76 eV) and O K (532 eV), showing that the core contains high concentration of Fe and Al, while the shell is composed mainly of Al and O.

FIG. 2, (a) shows an HRTEM micrograph image, showing the single crystalline core with interplanar distance of 2.03 angstroms encapsulated in an amorphous shell. FIG. 2, (b) is the corresponding FFT and FIG. 2, (c) is an electron diffraction pattern in the [00-1] zone axis orientation calculated by Crystal Maker™ software. The structure can be assigned to the $DO_3$ phase.

FIG. 7, (a) shows core-loss spectra for the measured areas 1-3 (shown in the image on the right), and (b) shows low-loss spectra for the areas 1-3.

DESCRIPTION OF EMBODIMENTS

The present disclosure provides a novel approach to overcome the limitations of the existing art. In one aspect, the present disclosure provides a general approach to gas phase synthesis of stable soft magnetic alloy nanoparticles. Iron aluminide nanoalloys of the $DO_3$ phase encapsulated in alumina shell were manufactured using co-sputter inert gas condensation technique. The role of the inert shell is to reduce the inter-particle magnetic interactions and prevent further oxidation of the crystalline core. The nanoparticles display high saturation magnetization (170 emu/g) and low coercivity (>20 Oe) at room temperature. The surface of these nanoparticles could be modified with polymer, such as gum arabic (GA), to ensure their good colloidal dispersion in aqueous environments.

High-resolution transmission electron microscopy (HR-TEM), scanning electron microscopy (SEM), aberration-corrected scanning transmission electron microscopy (STEM), and electron energy loss spectroscopy (EELS) were employed to examine the nanoparticles morphology, structure, and composition of the resulting soft magnetic alloy nanoparticles.

X-ray photoelectron spectroscopy (XPS) was used to determine the oxidation state of the Fe and Al. Magnetization measurements using vibrating sample magnetometer (VSM) at different temperatures were carried out to evaluate the magnetic behavior of the nanoparticles.

In an embodiment of the present invention, nanoparticles were fabricated via gas aggregated co-sputtering (NPLs 4 and 5) of Fe and Al from two independent neighboring targets on a silicon substrate in high vacuum chamber. Details of the manufacturing setup and conditions will be provided later in this disclosure. The main advantages of this method are that: (1) oxidation at low rates (high vacuum conditions and room temperature in the main chamber, which will be described with reference to FIG. 6 below) leads to segregation of pure alumina shell (NPL 6); and (2) the desired chemical composition of the nanoparticles can be obtained by controlling the volume fraction of each element. In the configuration made by the present inventors, this was achieved by tuning the magnetron power applied on each target (Fe and Al) independently while co-sputtering.

Figure 1:
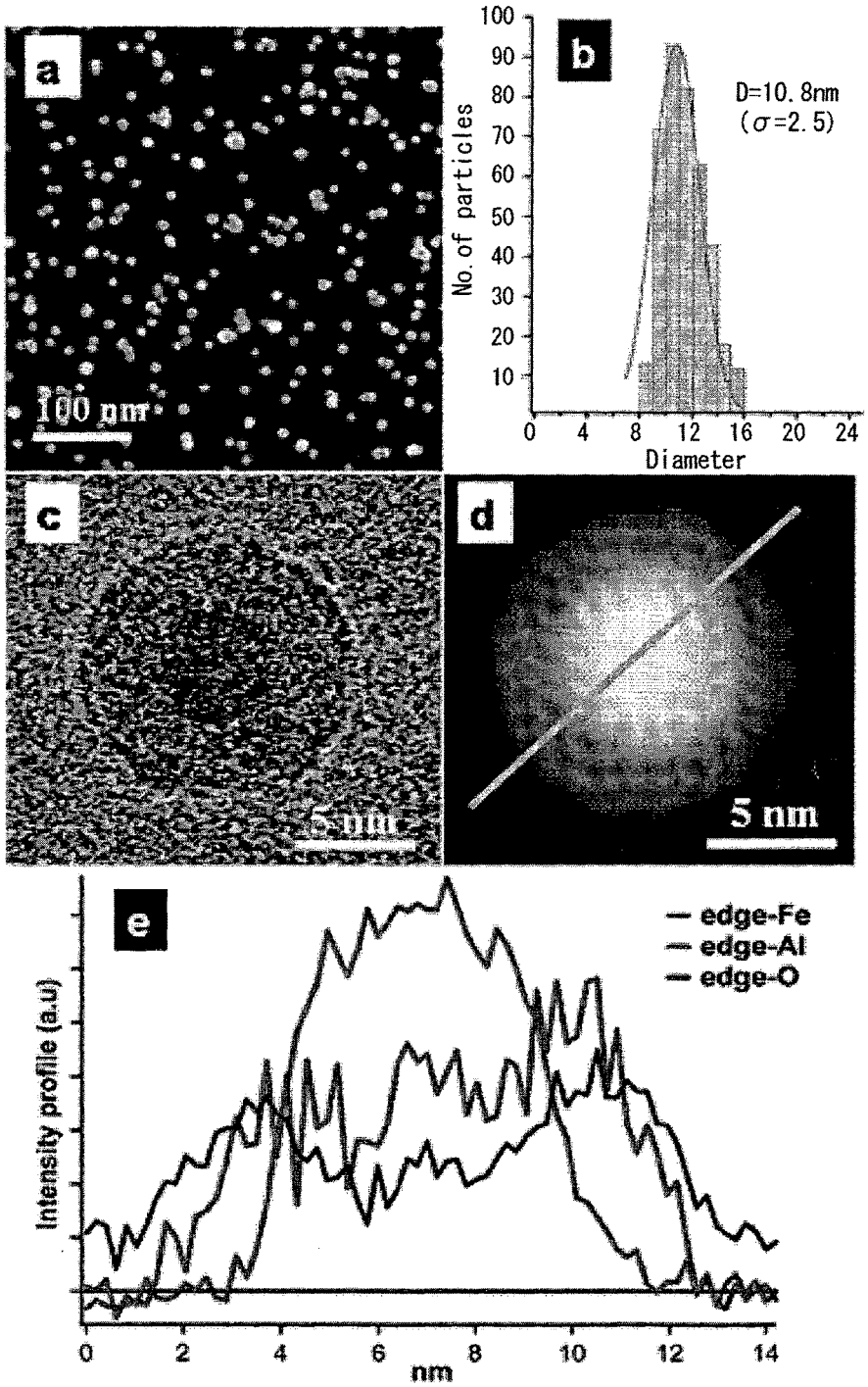
FIG. 1 shows morphology and chemical composition of manufactured nanoparticles according to an embodiment of the present invention.

FIG. 1 shows morphology and chemical composition of the manufactured nanoparticles. FIG. 1, (a) is a SEM image of the as-deposited nanoparticles. FIG. 1, (b) shows a size distribution of the nanoparticles showing an average diameter of 10.8 nm+−2.5 nm. FIG. 1, (c) is a TEM micrograph image of one nanoparticle. FIG. 1, (d) is an ADF-STEM image of a representative nanoparticle. FIG. 1, (e) is EELS line profiles along the line drawn in (d). As shown in FIG. 1, (a) and (b), the nanoparticles are monodispersed and show no signs of agglomeration with an average diameter of 10.8 nm+−2.5 nm. TEM and STEM images (FIG. 1, (c) and (d), respectively) show that the nanoparticles have uniform spherical shape with distinctive core-shell structure. The EELS line profile (FIG. 1, (e)) taken along the line indicated FIG. 1, (d) reveals a high concentration of Fe ($FeL_{2,3}$ at 707 eV) and Al (Al $L_{2,3}$ at 76 eV) in the core, while the shell is composed mainly of Al and O (OK at 532 eV).

Figure 2:
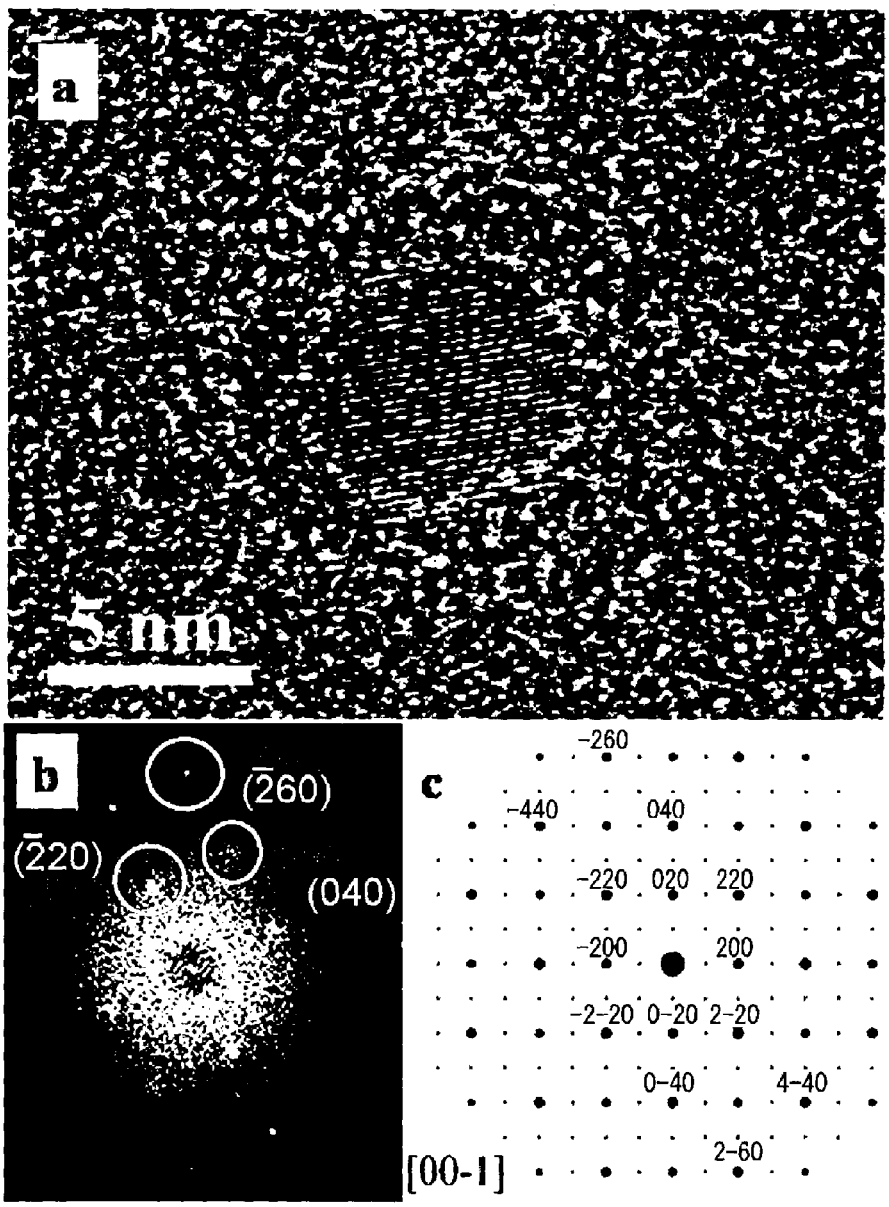
FIG. 2 shows the observed crystal structure of the nanoparticles according to the embodiment of the present invention.

High-resolution TEM (HRTEM) image (FIG. 2, (a)) indicates that the core is crystalline while the shell is amorphous. The interplanar distance estimated from the lattice fringes is found to be 2.03 angstroms, which can be assigned to the Fe-rich A2, the B2 or $DO_3$ phase. However, the high temperature ordered B2 phase is not expected in this case due to the relatively low temperature of the gas-phase involve in an inert gas condensation technique (NPL 7). The Fast Fourier Transform (FFT) of the HRTEM lattice of the core shown in FIG. 2, (b) with the electron diffraction pattern in the [00-1] zone axis orientation calculated by Crystal Maker software (FIG. 2, (c)) confirmed the presence of the $DO_3$ phase.

Figure 3:
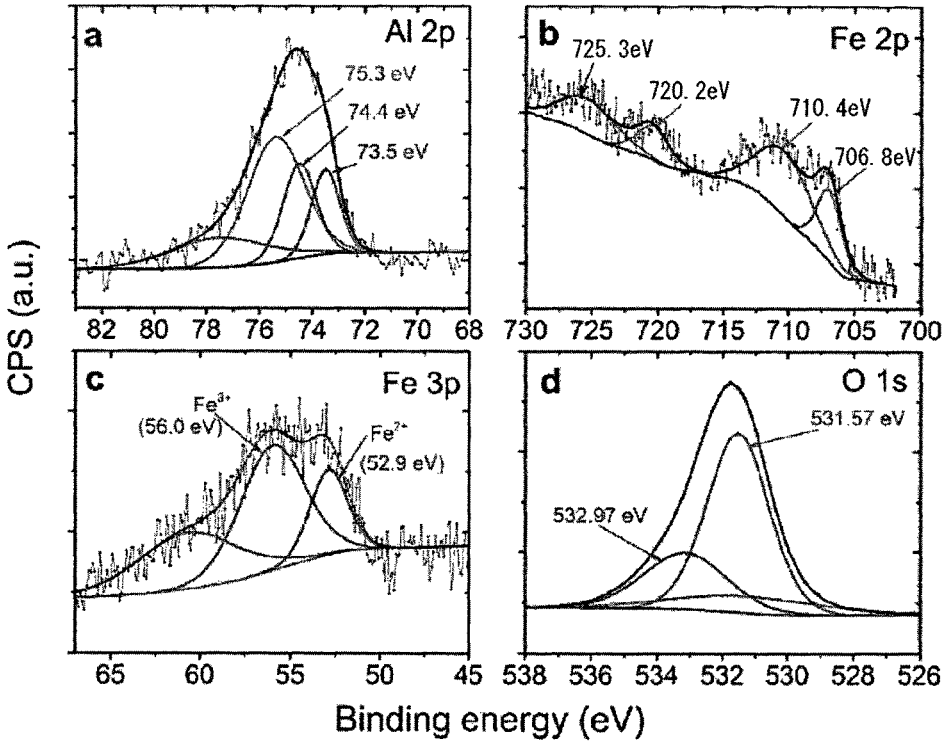
FIG. 3 shows composition and oxidation states of the nanoparticles according to the embodiment of the present invention measured by XPS, showing photoemission spectra and curve fittings for the Al 2p region (a), for the Fe 2p region (b), for the Fe 3p regions (c), and for the O 1s region (d), after exposure to air.

XPS core level spectra Al2p, Fe2p, Fe3p and O1s are measured and plotted in FIG. 3, (a)-(d), respectively. The spectra show that Fe and Al are present in both metallic (73.5 eV and 706.8 eV) and oxide (74.4 eV and 710.4 eV) states. The ratio between the peak areas of metallic Al2p (73.5 eV) and Fe2p (706.8 eV) is about 27%, corresponding to the $DO_3$ phase ($Fe_{73}Al_{27}$) in the binary phase diagram of iron aluminide.

Moreover, the peak corresponding to metallic Al (FIG. 3, (a)) is found to shift towards higher binding energy (73.4 eV instead of 72 eV), which suggests Al atoms coordination to Fe atoms. This matches exactly the reported value of the $Fe_3Al$ phase (NPLs 6 and 8). The peak at 75.3 eV binding energy (FIG. 3 (a)) is an indication of formation of $Al_2O_3$ on the surface. The same conclusion can be drawn from the O 1 s peak (FIG. 3, (d)) at 532.97 eV, which corresponds to the reported value for $Al_2O_3$ (NPL 8). The deconvolution of Fe3p peak to $Fe^{2+}$ and $Fe^{3+}$ peaks with atomic ratio of 1:2 (FIG. 3 (c)), in combination with the Al2p peak at 74.4 eV and the O1 s peak at 531.57 eV suggest the presence of spinel oxide $FeAl_2O_4$ in the inert shell (NPL 9 and 10).

Figure 4:
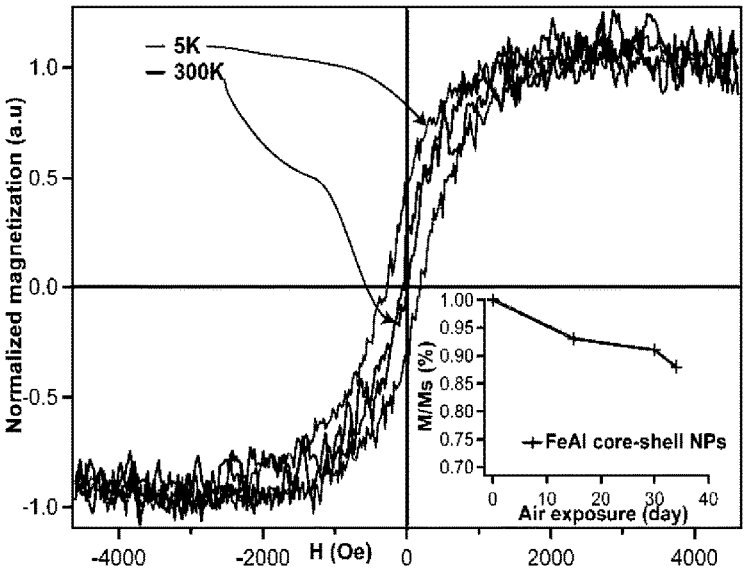
FIG. 4 is a measured normalized magnetization as a function of magnetic field. The outer lines indicate the magnetization at 5K and the inner lines at 300 K.

FIG. 4 is a normalized measured magnetization M (H) as a function of the applied magnetic field. The outer lines indicate the magnetization at 5K and the inner lines at 300 K. The nanoparticles show good stability against further oxidation (evaluated by measuring the normalized magnetization M/Ms as a function of time after exposure to air, as shown in the inset). The magnetization value is about 90% of the initial Ms after 1 month. A typical ferromagnetic behavior was observed at low temperature (5K). The coercive field (Hc) decreases from 280 Oe to less than 20 Oe as the temperature increases from 5K to 300K, indicating a soft magnetic behavior. The saturation magnetization (Ms) is found to be 204 emu/g at 5K and 170 emu/g at 300K. These values are high compared to the Ms values reported so far for iron aluminide alloys (NPLs 11-13), and is higher than that of iron oxide nanoparticles with similar size (typically range from 70-110 emu $g^{-1}$) (NPLs 14 and 15). Interestingly, our iron aluminide nanoparticles display high stability against oxidation compared to other iron-based nanoparticles reported in literature, as shown in FIG. 4, inset (NPLs 16-17). The low value below 0.5 (non-interacting particles) of the remainence ratio Mr/Ms in FIG. 4 could be explained simply by the effect of competition between the inter and intra particle interaction on the spin relaxation process (NPL 18) and as a result of the encapsulation by the alumina shell, which provides weak inter-particles interactions. All of these values are listed in Table 1 below.

TABLE 1

| T (k) | Ms (emu/g) | Mr (emu/g) | Mr/Ms | Hc (Oe) |
|---|---|---|---|---|
| 5 | 204 | 91 | 0.45 | 280 |
| 300 | 170 | 25 | 0.15 | 20 |

Table 1 shows measured hysteresis loop parameters at 5K and 300K of the manufactured nanoparticles. Saturation magnetizations (Ms) and remanence magnetizations (Mr) are calculated using SEM distribution and XPS average composition (calculated error about +−10%). As shown in the measured data, the FeAl nanoparticle according to the embodiment of the present invention exhibit superior magnetization properties.

To stabilize the nanoparticles in water, the surface of these magnetic nanoparticles may be coated with a bio-polymer, such as gum arabic (GA) for potential applications in biomedicine (NPL 19). The details of the coating process will be explained with reference to FIG. 9 below.

Figure 5:
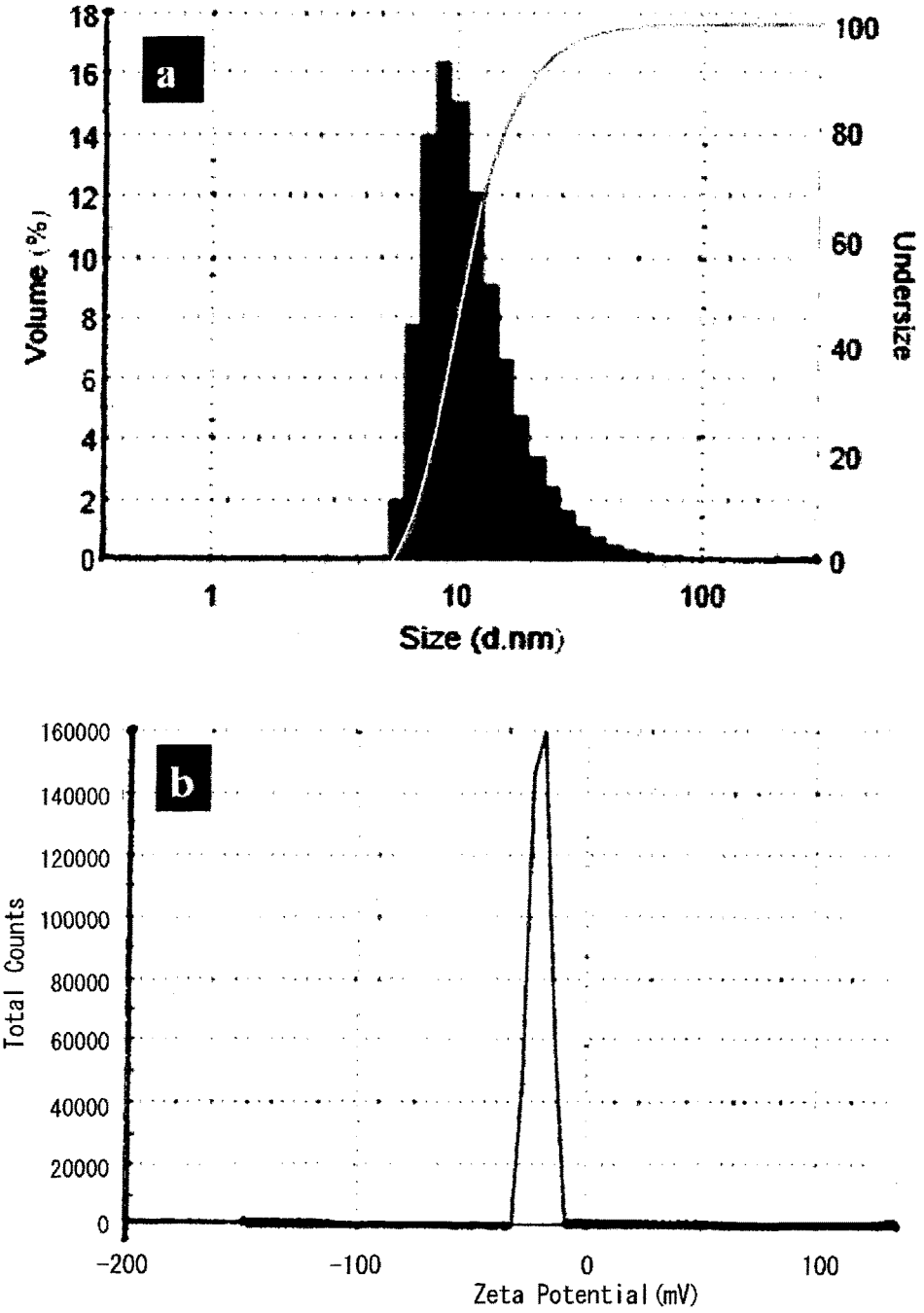
FIG. 5 shows a size distribution (a) measured using dynamic light scattering (DLS) and zeta potential measurements (b), of iron aluminide nanoparticles coated with GA in water according to an embodiment of the present invention.

The size distribution and the colloidal stability of GA coated iron aluminide nanoparticles according to an embodiment of the present invention in water were evaluated using dynamic light scattering (DLS) and zeta potential measurements. The results are shown in FIG. 5, (a) and (b). The size distribution obtained is in agreement with FIG. 1, (b), and a zeta potential value of −21 mV, indicates a stable colloidal dispersion (NPL 20).

As described above, in one aspect of the present invention, a novel approach for the synthesis of soft magnetic alloy nanoparticles has been disclosed herein. This approach is general and can be applied to a wide range of materials. Iron aluminide nanocrystals encapsulated in alumina shell have been demonstrated. The high saturation magnetization and low corecivity of these nanoparticles make the manufactured nanoparticles a very promising candidate as soft magnetic materials for future nanotechnology and biomedical applications, such as writing heads for magnetic recoding devices and local hyperthermia for cancer treatment.

<Setup and Conditions for Manufacturing FeAl Nanoparticles>

Figure 6:
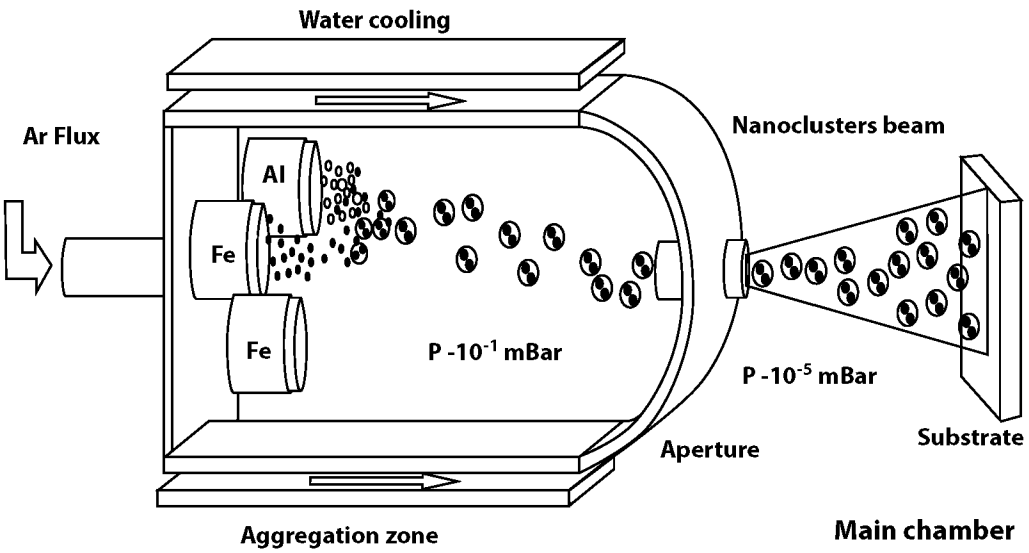
FIG. 6 is a schematic diagram of a modified inert-gas condensation magnetron co-sputtering apparatus used to manufacture soft magnetic nanoparticles of embodiments of the present invention.

The FeAl nanoparticles, as described above, were obtained using a modified inert-gas condensation magnetron sputtering apparatus shown in FIG. 6. FIG. 6 is a schematic diagram of the modified inert-gas condensation magnetron co-sputtering apparatus. FIG. 6 shows two Fe targets and one Al target. The diagram is divided into three parts: an aggregation zone where nucleation of Fe and Al clusters took place, followed by coalescence to produce larger nanoparticles; an aperture through which the as-nucleated alloy nanoparticles pass to create a nanocluster beam; and a main chamber to which the nanocluster beam of the nanoparticles directed to deposit the nanoparticles on the substrate. A supersaturated vapor of metal atoms is generated by co-sputtering in an argon (Ar) atmosphere. The aggregation chamber is water-cooled and evacuated down to about $10^{-6}$ mbar, prior to sputtering. High-purity Fe (99.9%) and Al (99.9995%) targets were used in the DC co-sputtering process. The constant pressure process was maintained at $3\times10^{-1}$ mbar in the aggregation zone and $8.4\times10^{-4}$ mbar in the main chamber, and the Ar flow rate was set to 80 sccm. This differential pressure is a key factor, which determines the residence time in the aggregation zone, and therefore, affects the crystallinity, size, and shape of the nanoparticles. The DC power applied to the one inch Fe and Al targets was fixed at 11 W and 16 W respectively. Due to the difference in atomic mass (Al: 1.426 angstroms and Fe: 1.124 angstroms) (NPL 21) and sputtering yields (Al: 0.42 and Fe: 0.47), the power for Al is higher than to that for Fe. The power ratio was fixed in order to work in the Fe-rich part of the Fe—Al binary phase diagram where the $DO_3$ and A2 phases are growth and stable at low-temperature (<500 degrees in Celsius). The nanoparticles are deposited on silicon substrates and silicon nitride TEM window grids for characterization. The aggregation zone length is set to 90 mm and the substrate is rotated during deposition. The size, morphology and crystal structure of these intermetallic nanoparticles were examined using a scanning electron microscope (SEM) FEI Quanta FEG 250 and an image-corrected scanning/transmission electron microscope (S/TEM) FEI Titan 80-300 kV operated at 300 kV. Electron energy loss spectroscopy (EELS) was performed to study individual NPs' composition using a Gatan GIF Quantum imaging filter. The chemical composition and oxidation coating of these samples were also evaluated using X-ray photoelectron spectroscopy (XPS) Kratos Axis UltraDLD 39-306 equipped with a mono AlK-alpha source operated at 300 W. Magnetization measurements as a function of the field and temperature were performed using a Cryogen-free physical property measurement system (PPMS) DynaCool from Quantum Design in a vibrating sample magnetometer mode (VSM).

<EELS Measurements>

Figure 7:
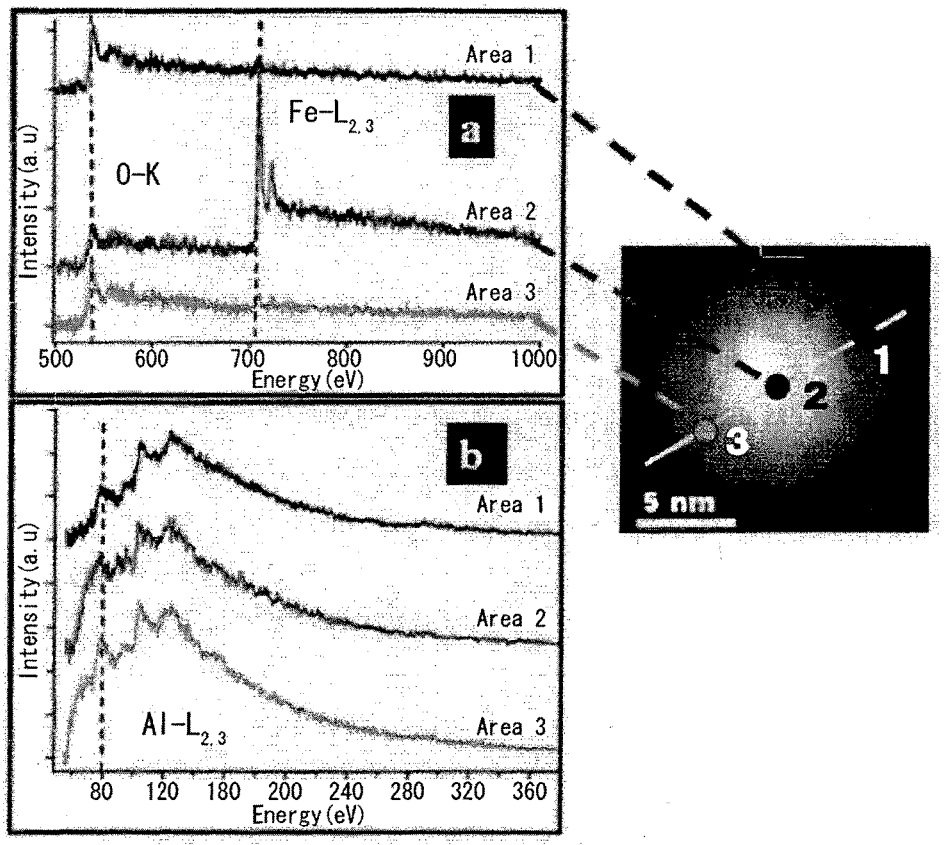
FIG. 7 shows EELS spectra obtained from different areas of a representative nanoparticle according to an embodiment of the present invention.

FIG. 7 shows EELS spectra obtained from different areas of the representative nanoparticles according to the embodiment of the present invention. The nanoparticle is composed of a bright core surrounded by a shell which is less shiny. The identification of each element depends on the difference in contrast in ADF image which is related to the atomic number. The presence of an Fe—Al core rich in Fe is demonstrated by the bright contrast. Spatially resolved chemical information from these nanoparticles was acquired by obtaining electron energy loss spectrum from a series of points across the representative NP in a STEM configuration, as shown in the left image of FIG. 7. FIG. 7, (a) shows core-loss spectra for the measured areas 1-3, and (b) shows low-loss spectra for the areas 1-3. STEM-EELS spectrum of the areas 1-3 show the presence of Fe, Al and O within the NP. As can be seen in (a) and (b), the area 1 shows a strong edge of Fe-$L_{2,3}$ corresponding to the position of the bright core, while the spectra on either side (area 2 and area 3) of the core are dominated by Al-$L_{2,3}$ and O—K edge.

<Crystal Structure>

Figure 8:
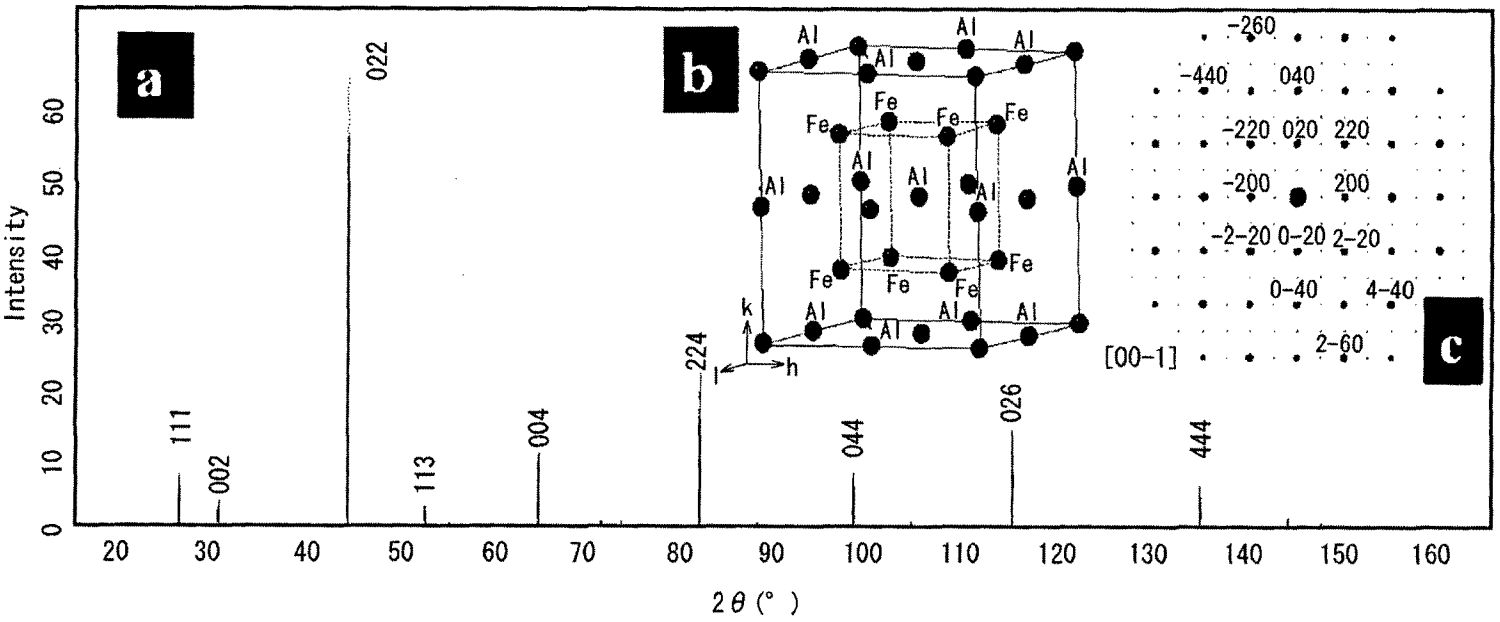
FIG. 8 shows simulated X-ray powder diffraction pattern (a) of the $DO_3$ structure (b) and the corresponding electron diffraction pattern in [00-1] zone axis (c).

FIG. 8 shows simulated X-ray powder diffraction pattern (a) of the $DO_3$ structure (b) and the corresponding electron diffraction pattern in [00-1] zone axis (c), obtained using Crystal Maker™ software. The $DO_3$ is a derivative-bcc structure consisting in four interpenetrating fcc sublattices. The reflections in the FFT analysis (FIG. 2, (b)) are comparable to those reflections in the simulated diffraction pattern in FIG. 8. It can be seen that all of the calculated lattices spacing and angles in the FFT (FIG. 2) matches perfectly with those values obtained by Crystal Make™ (Table 2). Table 2 shows calculated values from the FFT analysis and simulated values by Crystal Maker™ of the corresponding d-spacing and angles. Further, the calculated lattice parameter with experimental d-spacing (5.769) is in good agreement with the known lattice parameter (5.792) (NPL 22). It is important to note that the small difference in lattice parameter can be explained by compressive strain in small size nanoparticles.

TABLE 1

| $DO_3$ phase | Calculated from FFI (FIG. 2) | | Simulated values | |
|---|---|---|---|---|
| bkl | $d_{bkl}$ (Å) | angles (deg.) | $d_{bkl}$ (Å) | angles (deg.) |
| 220 | 2.04 | 46 | 2.0478 | 45 |
| 400 | 1.46 | | 1.448 | |
| 220 | 2.04 | 26 | 2.0478 | 26.57 |
| 620 | 0.93 | | 0.9158 | |
| 400 | 1.46 | 20 | 1.448 | 18.43 |
| 620 | 0.93 | | 0.9158 | |
| 220 | 2.04 | 90 | 2.0478 | 90 |
| 440 | 1.025 | | 1.0239 | |

<Harvesting Procedure>

Figure 9:
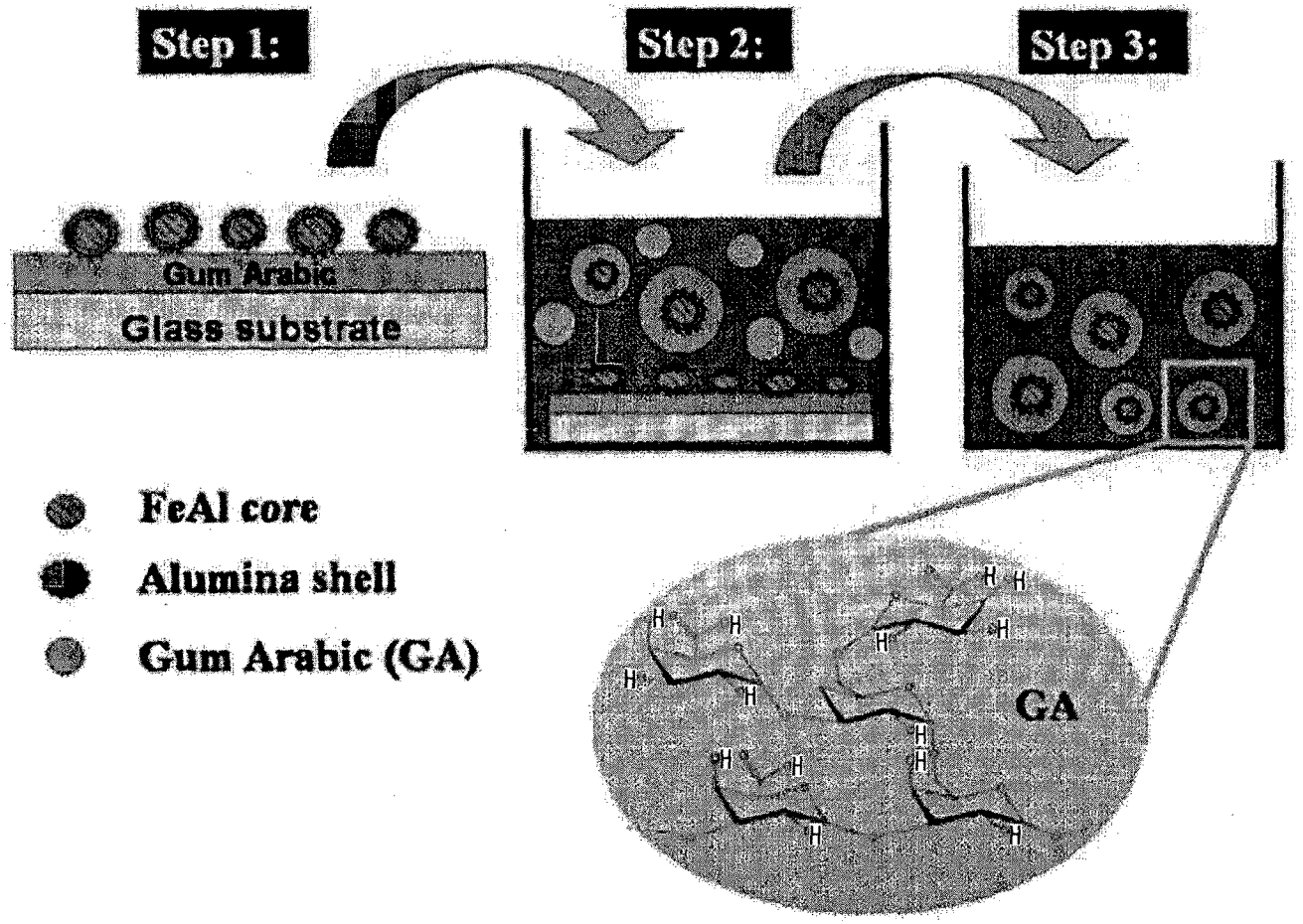
FIG. 9 schematically shows a harvesting procedure employed for the magnetic nanoparticles coated with Gum Arabic (GA).

FIG. 9 schematically shows a harvesting procedure employed for the magnetic nanoparticles coated with Gum Arabic (GA).

<Step 1>

To form a gum arabic (GA) film, a glass slide substrate (76 mm×26 mm) was thoroughly rinsed in dry ethanol for 10 min under ultrasonication, then dried under $N_2$ gas. 10 mg of GA (Sigma-Aldrich, St. Louis, US) was dispersed in 250 μL of deionized (DI) water solution and gently dispensed onto the cleaned glass substrate. A thin GA film was formed by a spin-coater (MS-A-150, MIKASA, Japan) operated at 3,000 rpm for 30 sec.

<Step 2>

NPs were exfoliated by immersing the NPs/GA/glass samples in DI water and sonicating for 15 min, followed by a separation step to remove the excessive GA polymer using a centrifuge at 100,000 rpm for 60 min.

<Step 3>

After washing the precipitated NPs with 50% methanol in DI water, the NPs were redispersed in DI water from a Milli-Q system (Nihon Millipore K. K., Tokyo, Japan) using 0.1 μm filters.

The present disclosure describes the design and assembly of stable soft magnetic alloy nanoparticles. A number of diagnostic methods were utilized for their characterization. Embodiments of the present invention have a wide range of biomedical and other technological applications.

It will be apparent to those skilled in the art that various modification and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

The invention claimed is:

1. A method for forming soft magnetic nanoparticles each comprising an iron aluminide nanoalloy of the $DO_3$ phase as a core encapsulated in an inert shell made of alumina, the method comprising:

producing a supersaturated vapor of metal atoms of Al and Fe in an aggregate zone by co-sputtering Fe atoms and Al atoms in an Ar atmosphere;

producing nanoparticles from the supersaturated vapor;

causing the nanoparticles to pass through an aperture with a pressure differential before and after the aperture so as to create a nanocluster beam of the nanoparticles emerging from the aperture; and directing the nanocluster beam to a substrate to deposit the nanoparticles onto the substrate.

2. The method according to claim 1, wherein the step of producing the super saturated vapor includes applying separate magnetron powers to an Al target and to an Fe target for sputtering.

3. The method according to claim 1, further comprising exposing the nanoparticles deposited on the substrate to an oxidizing atmosphere to oxide a surface of the nanoparticles.

* * * * *